US005819920A

United States Patent [19]

Sutherland

[11] Patent Number: 5,819,920

[45] Date of Patent: Oct. 13, 1998

[54] BASKET-STYLE CARRIER WITH CUTOUTS

[75] Inventor: Robert L. Sutherland, Kennesaw, Ga.

[73] Assignee: Riverwood International Corporation, Atlanta, Ga.

[21] Appl. No.: 951,848

[22] Filed: Oct. 16, 1997

[51] Int. Cl.[6] ..... B65D 75/00

[52] U.S. Cl. ..... 206/174; 206/194

[58] Field of Search ..... 206/140, 147, 206/152, 162, 167, 170, 174, 175, 180, 183, 184, 186, 187, 190, 194, 198, 427, 429, 434

[56] References Cited

U.S. PATENT DOCUMENTS

| | | | |
|---|---|---|---|
| 2,460,108 | 11/1949 | Smith et al. | 206/183 X |
| 2,575,654 | 11/1951 | Casler | 206/183 |
| 3,442,421 | 5/1969 | Donahue | 206/183 |
| 3,814,238 | 6/1974 | Wood | 206/167 |
| 5,458,234 | 10/1995 | Harris | 206/187 |
| 5,657,864 | 8/1997 | Harrelson | 206/152 |
| 5,657,865 | 8/1997 | Harrelson | 206/194 |

*Primary Examiner*—Bryon P. Gehman

[57] ABSTRACT

A basket-style carrier with rounded corners and a partial top panel. Cutouts in the side and end panels are designed to receive reinforcing struts of molded plastic shipping trays when packed in such trays. The bottom panel of the carrier is comprised of a bottom panel section connected to a center support panel and bottom panel flaps connected to the side panels. The dimensions of the carrier and the location of cell divider partitions are such that the corner areas of the carrier are forced into rounded shape by the bottles being loaded into the carrier.

20 Claims, 4 Drawing Sheets

BASKET-STYLE CARRIER WITH CUTOUTS

FIELD OF THE INVENTION

This invention relates to a basket-style carrier for carrying articles such as beverage bottles. More particularly, it relates to a basket-style carrier which securely holds the bottles in place and is adapted to be shipped in a post-style merchandising tray.

BACKGROUND OF THE INVENTION

Basket-style carriers are commonly employed to package beverage bottles. They conventionally include a separate cell for each bottle, from which the bottles can be readily removed, and a handle for carrying the package. The carriers are fabricated from a blank which is folded and glued into collapsed carrier form, after which the collapsed carrier is erected and the bottles inserted.

Basket carriers have commonly been shipped to marketing sites in packing trays of rectangular shape designed to hold four rectangular basket carriers, with the smooth inner faces of the packing tray walls being dimensioned to allow the carriers to tightly fit after being dropped into place. More recently, packing trays formed of molded plastic have been designed to hold loose bottles, intended to be sold as individual units. For example, twenty-four individual bottles may be shipped in a molded tray instead of four six-packs in a conventional paperboard tray. For purposes of strength molded trays make use of reinforcing struts which extend from the tray walls diagonally down to the tray bottom. These struts fit between adjacent outer bottles in the tray. It would be convenient to be able to make use of such molded trays to ship basket carriers as well as individual bottles, but this is not possible for the usual basket carrier design since four such basket carriers cannot fit into the reduced interior packing space of the trays.

It has been suggested to provide open areas in the basket carriers to receive the reinforcing struts of the trays. In this way the struts would not encounter interference from the bottles or the carrier structure. Such openings would also allow the lower portions of the bottles to be viewed while in the carrier, which is advantageous from a sales point of view. While carriers containing these cutouts have been designed to fit into molded packing trays, their straight sides and ends still make it difficult to fit them into the trays. Also, the presence of cutout areas in the side and end panels makes it difficult to maintain the carriers at the desired level of strength while at the same time providing for a tight fit between the carriers and the packaged bottles.

It is therefore an object of the invention to provide a basket carrier which has cutouts in the lower portions of the side panels, yet is able to prevent bottles from falling out when the carrier is lifted. Another object is to provide a basket carrier of this design which is able to withstand the stress of being dropped into place in a molded post-style packing tray and to tightly maintain the bottles within the carrier during the process.

BRIEF SUMMARY OF THE INVENTION

The basket style carrier of the invention includes a number of significant features. In its broadest aspect the carrier is comprised of opposite side panels containing spaced cutouts, opposite end panels connected to the side panels and a center support panel between the side panels. Each end panel is comprised of two adjacent end panel sections connected to the center support panel. A bottom panel is also connected to the center support panel. Bottom panel flaps connected to the side panels between the cutouts are attached to the bottom panel. Preferably, each end panel also includes a cutout adjacent the center support panel and the bottom panel. The cutouts in the side and end panels enable carriers containing beverage bottles to be packed in molded shipping trays, with the reinforcing struts of the trays fitting into the cutouts. This allows the carriers to fit into trays originally designed to hold only individual bottles.

In a preferred arrangement the bottom panel includes intermediate fold lines about which the panel is folded upon itself to make a multi-ply structure. Also, a top panel including openings for receiving the necks of packaged bottles is connected to the side panels.

In order to enable the carrier to fit tightly about the curved surfaces of packaged bottles, the carrier is formed so that the introduction of the end bottles causes the end panels to substantially conform to their shape. The carrier also preferably includes a plurality of divider partitions extending from the center support panel to the side panels. The design of the divider partitions encourages the end panels to curve outwardly, as explained in detail below.

The carrier is structurally sound and economical to produce. In addition, it meets the desired objectives stated above. These features and aspects of the invention referred to above, and others as well, will be readily ascertained from the detailed description of the preferred embodiments described below.

DETAILED DESCRIPTION OF THE PREFERRED EMBODIMENT

Figure 1:
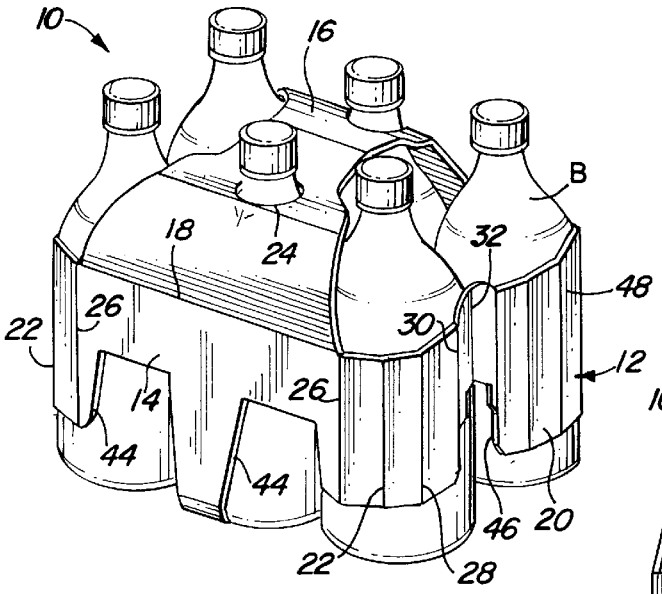
FIG. 1 is a pictorial view of the carrier of the invention, shown holding six beverage bottles.
Figure 2:
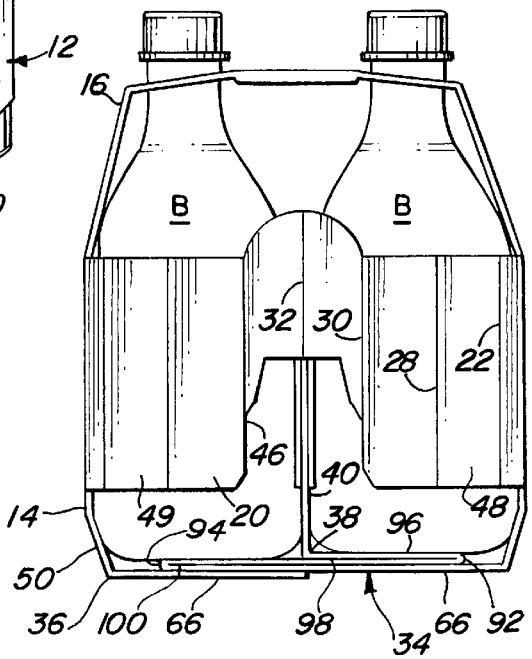
FIG. 2 is an end view of the carrier.
Figure 3:
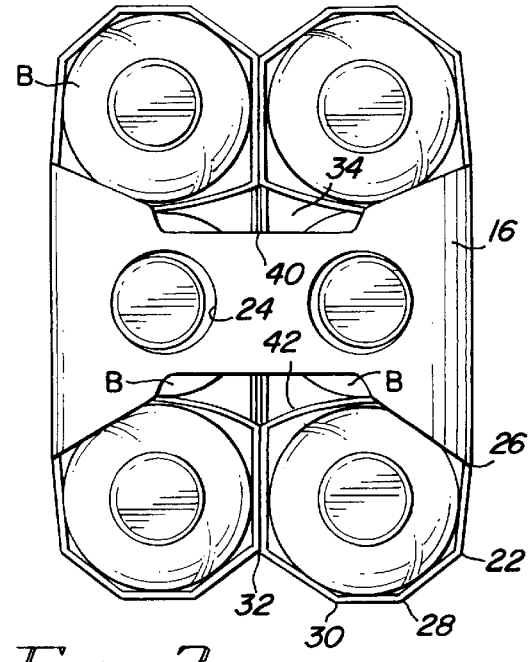
FIG. 3 is a top view of the carrier.

Referring to FIGS. 1, 2 and 3, the package 10 is comprised of two adjacent parallel rows of three bottles B contained in basket-style carrier 12. The carrier includes opposite side panels 14 connected to partial top panel 16 by fold lines 18 and to opposite end panels 20 by fold lines 22. The end edges of the top panel 16 are angled inwardly so that the top panel extends over only the two middle bottles, allowing the end bottles to remain uncovered. Bottle neck openings 24 in the top panel allow the necks of the two middle bottles to extend up through the top panel. Fold line 26 in the side panels, fold lines 22 and additional fold lines 28, 30 and 32 in the end panels facilitate the ability of the end panels and the end portions of the side panels to substantially curve around and follow the contour of the end bottles. Bottom panel 34 supports the bottles and is connected by fold lines 36 to the side panels 14 and by fold line 38 to center support panel 40. Individual cells for receiving the bottles are formed by divider partitions 42 which extend from the center support panel 40 to the side panels. The partitions 42 also conform to a portion of the contour of adjacent end bottles.

The carrier further includes two large open areas 44 in each side panel and a large open area 46 in each end panel. As shown more clearly in FIG. 11, the bottom panel is recessed from the side and end panels, which allows reinforcing struts or posts of a packing tray to extend slightly into the interior of a packed carrier through the open areas. The open areas also act as windows to the interior of the carrier, exposing sufficient amounts of the lower portions of each bottle so that, together with the exposed upper bottle portions, a customer can readily appreciate the overall shape of the bottles regardless of the angle of view. This can be a significant commercial feature when the shape of the bottle is associated with the source of the product and is thus part of the process of brand recognition. The end panels 20 are formed from end panel sections 48, the upper portions of which are connected by adjacent fold lines 32 to the central support panel 40.

It will be noted that the end panels terminate above and are unattached to the bottom panel, and that the side panels are connected to the bottom panel by only a narrow strip 50 of the side panels which separates the open areas 44. This would make it appear that the carrier would not have the ability to adequately support a full load of bottles during lifting and during the tray loading process without great risk of failure. Just the opposite is true. As will be explained below, the carrier possesses a great deal of strength and is easily capable of withstanding the rigors of handling and the shock caused by the carrier being dropped into place in a packing tray.

Figure 4:
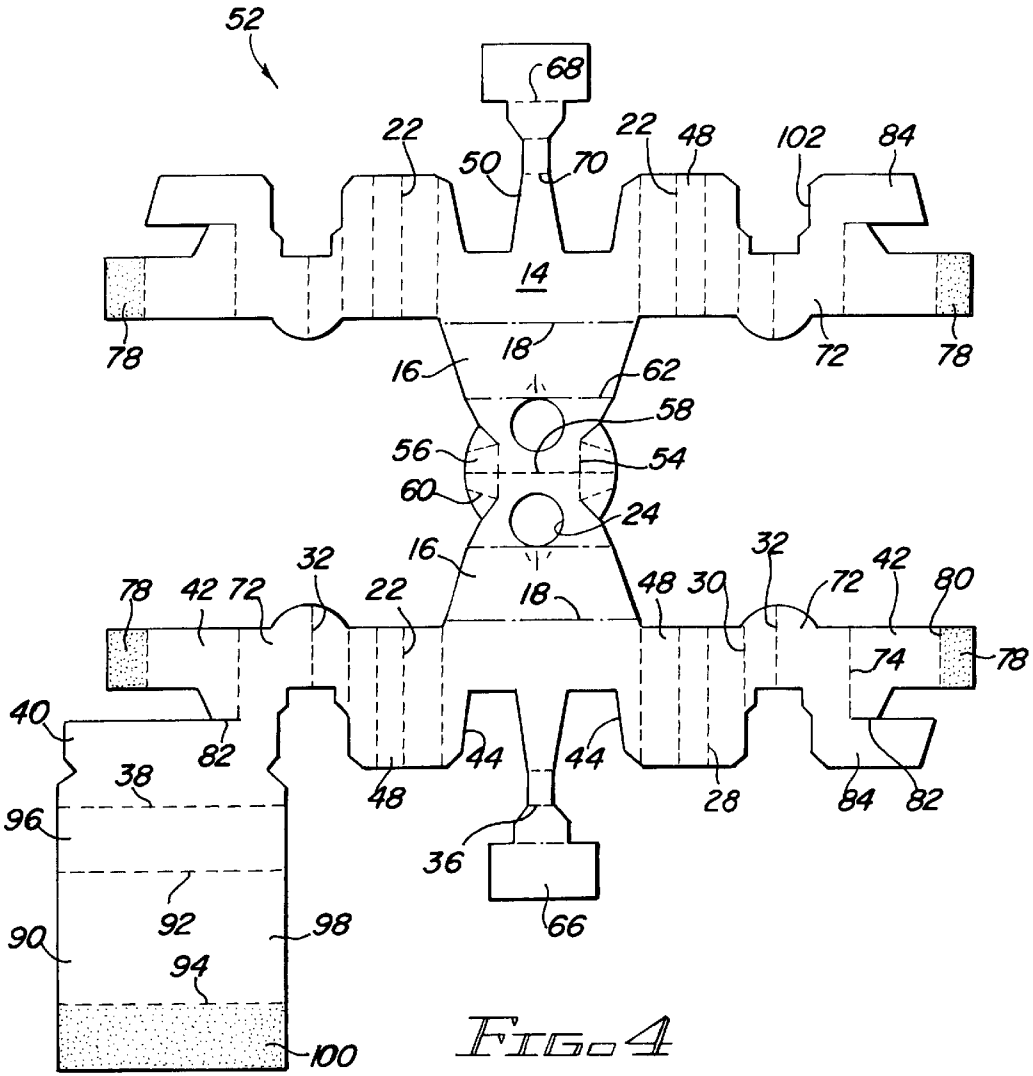
FIG. 4 is a plan view of a blank for forming the carrier of FIG. 1.

Referring now to FIG. 4, wherein like reference numerals to those used in FIGS. 1, 2 and 3 denote like elements, a blank 52 for forming the carrier is comprised of paperboard of the type conventionally used in the carrier industry or other material having sufficient strength and flexibility properties. The centrally located top panel section 16 is connected at opposite ends by the fold lines 18 to the side panel sections 14. The narrowed central portion of the top panel section acts as a handle intended to be grasped at opposite ends. Connected to the opposite end edges of the handle portion by fold lines 54 are handle flaps 56. Center fold line 58 extends across the handle portion of the top panel section and through the handle flaps 56. Additional fold lines 60 are provided in the handle flaps to permit flexing when in use, as noted below. The bottle neck openings 24 are located on opposite sides of the center fold line 58, and intermediate fold lines 62 extend across the top panel section adjacent the outer edges of the openings 24. Connected to the side panel strips 50 by the fold lines 36 are bottom panel flaps 66. The bottom panel flaps contain intermediate transverse fold lines 68 while the side panel strips 50 contain intermediate fold lines 70, both of which facilitate flexing of the side panel strips and the bottom panel flaps to more closely conform to the shape of the bottom portions of packaged bottles.

The end panel sections 48 are connected at one end by the fold lines 22 to the side panel sections and at the opposite end by the fold lines 32 to center support panel sections 72. Each support panel section 72 is connected by fold line 74 to a divider partition flap 42 which includes glue flap 78 connected to it by fold line 80. The support panel sections 72 include outwardly extending legs 84 and 40 separated from the connected partition flaps 42 by slits 82. The three legs 84 terminate short of the end of the associated glue flap 78. The fourth leg 40 extends beyond its associated glue flap 78 and is of greater width. The leg 40 is connected by fold line 38 to bottom panel section 90, which is divided by spaced intermediate transverse fold lines 92 and 94 into an upper portion 96, an intermediate portion 98 and a lower portion 100. The cutout open areas 44 in the side panel sections 14 are shown on opposite sides of the strip 50. Additional cutouts 102 are formed in adjacent portions of the end panel sections 48 and the support panel sections 72.

To form a carrier from the blank the lower bottom panel section portion 100 is coated with adhesive, as shown in stipple, and folded up about fold line 94 to adhere it to the intermediate bottom panel portion 98. The glue flaps 78 are also coated with adhesive, as shown in stipple, and the end panel sections 48 are pivoted about the fold lines 22, adhering the partition glue flaps to the side panel sections 14. After these folding and gluing operations the blank appears as in FIG. 5, with the support panel sections 72 and the divider partitions 42 overlying portions of the end panel sections 48. The folded lower bottom panel section portion 100 underlies the intermediate bottom panel section portion 98 and is not visible in this view.

Figure 5:
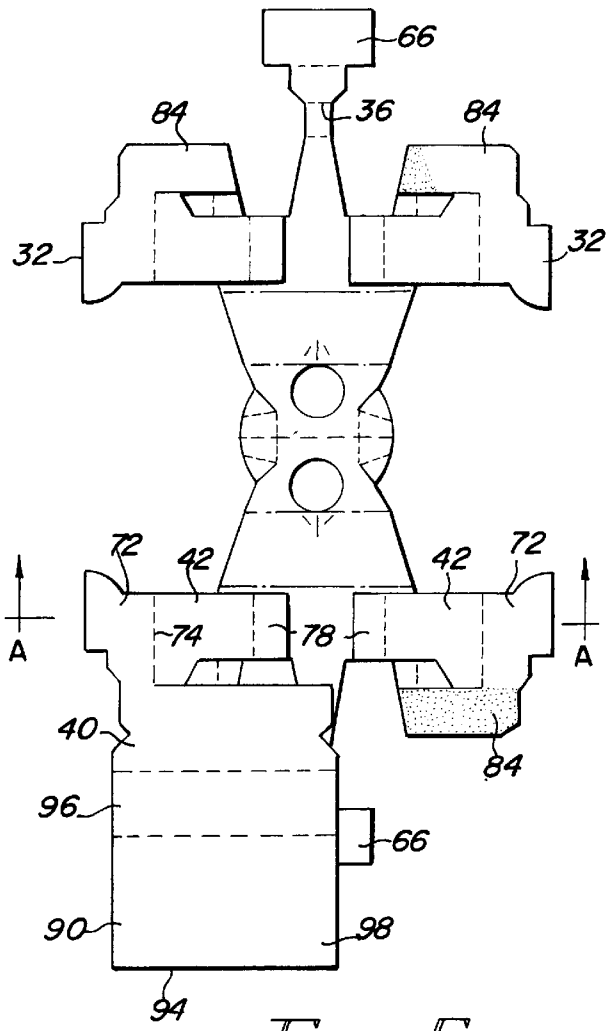
FIG. 5 is a plan view of the blank after an initial folding and gluing step.
Figure 6:
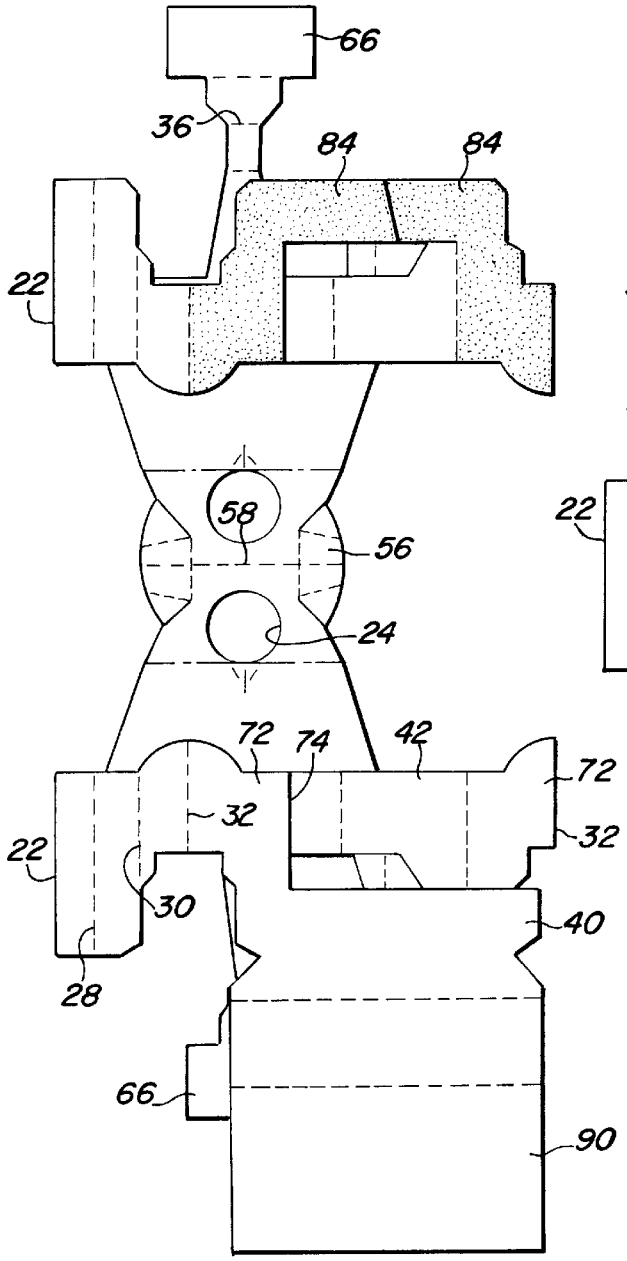
FIG. 6 is a plan view of the blank after a further folding and gluing step.
Figure 7:
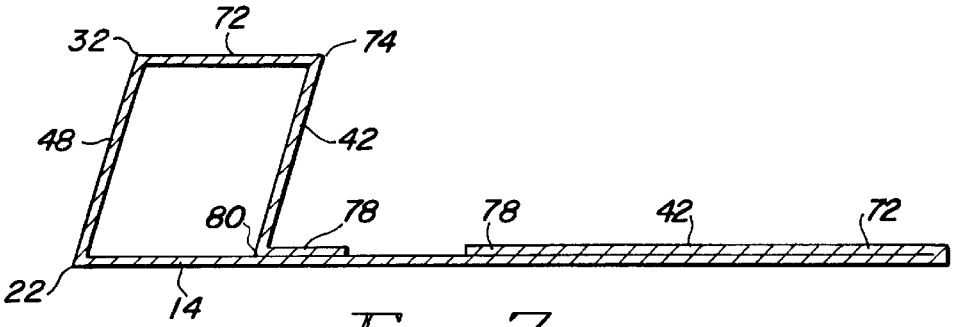
FIG. 7 is a transverse sectional view, as viewed along the line A—A of FIG. 5, of the carrier blank in an interim stage as the blank is being folded from the condition shown in FIG. 5 to the condition shown in FIG. 6.

Glue is then applied to the support panel legs 84 on the right side of the blank as shown in stipple in FIG. 5. The support panel sections 72 at the left side of the blank and the connected divider partitions 42 are then swung to the right, bringing the support panel legs 84 and 40 on the left side of the blank into overlying relationship with the support panel legs 84 at the right of the blank, as shown in FIG. 6. It will be appreciated that this maneuver is carried out with the glue flaps 78 remaining adhered to the side panel sections 14. Referring to FIG. 7, which shows the support panel sections 72 and the connected divider partitions 42 at an interim point during this folding step, as seen from the vantage point of the line A—A of FIG. 5, when the support panel sections 72 at the left side of the blank and the connected divider partitions 76 are swung to the right, the divider partitions 42 are pivoted up about the fold lines 80, which raises the connected support panel sections 72 and attached support panel legs 84 and 86. The support panel legs, as well as the bottom panel section connected to the leg 40, remain parallel to the plane of the side and end panel sections during the folding operation, while the portions of the side and end panel sections between the fold lines 32 and 22 move with and are parallel to the divider partitions 42.

Figure 8:
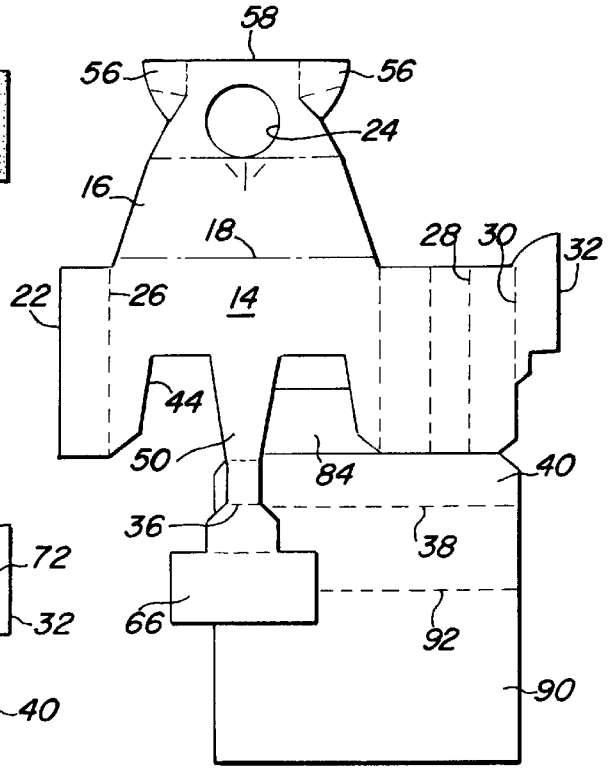
FIG. 8 is a plan view of a collapsed carrier after a final folding and gluing step.

After the blank has reached the condition of FIG. 6, glue is applied to the support panel sections 72 and the adhered legs 84 at the upper portion of the blank and the blank is folded about the center fold line 58 to form the collapsed carrier of FIG. 8. The support legs 84 which were located at the upper part of the drawing figure thus overlie and are adhered to the attached support legs 84 and at the lower half of the blank. Of course glue could just as well be applied to similar portions of the blank at the lower half of the blank instead of the upper half or to both, if desired.

Figure 9:
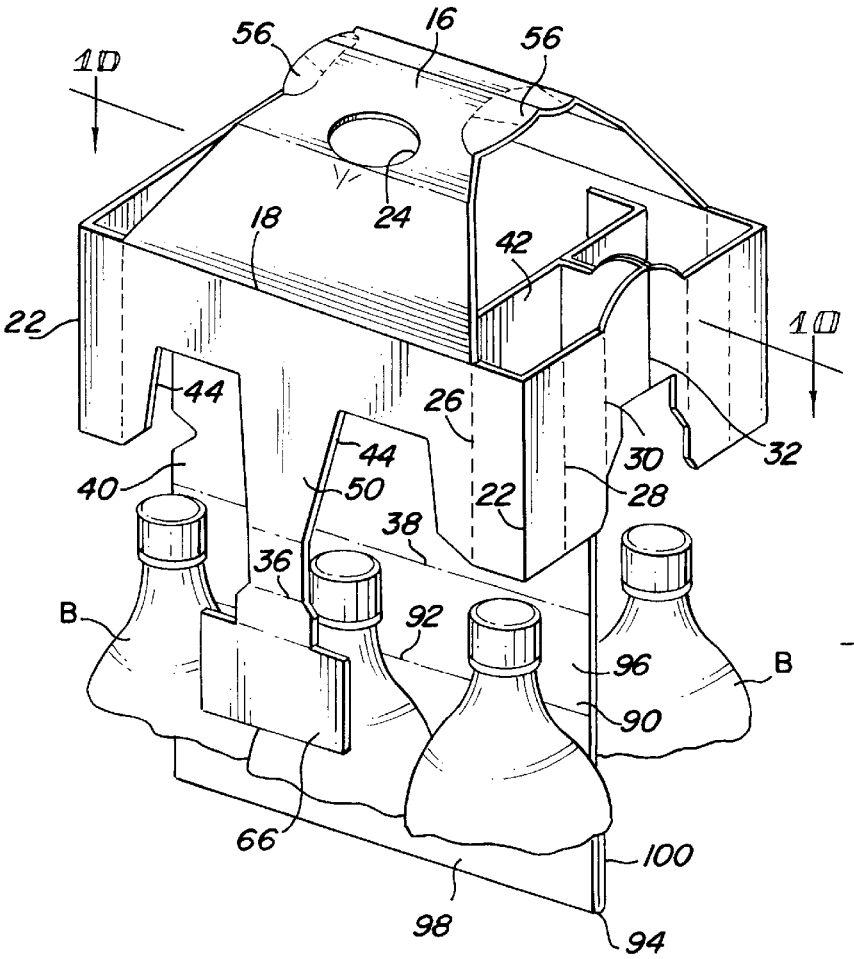
FIG. 9 is a pictorial view of an opened collapsed carrier in the initial stage of being loaded with beverage bottles.

To form a package from the collapsed carrier of FIG. 8, inward pressure is applied to the end folds 22 and 32, which opens the collapsed carrier, causing the divider partitions 42 to unfold and span the bottle receiving areas on each side of the center support panel. The open carrier, with the bottom panel flaps still open, is then moved down over the bottles to be packaged, as illustrated in FIG. 9. The bottles will have first been positioned in their final arrangement so that when the open carrier is moved down over them, the bottles are aligned with the cells created by the divider partitions and the middle bottles in each row are aligned with the bottle neck openings in the top panel. As illustrated, the bottom panel section 90 passes between the two rows of bottles.

Figure 10:
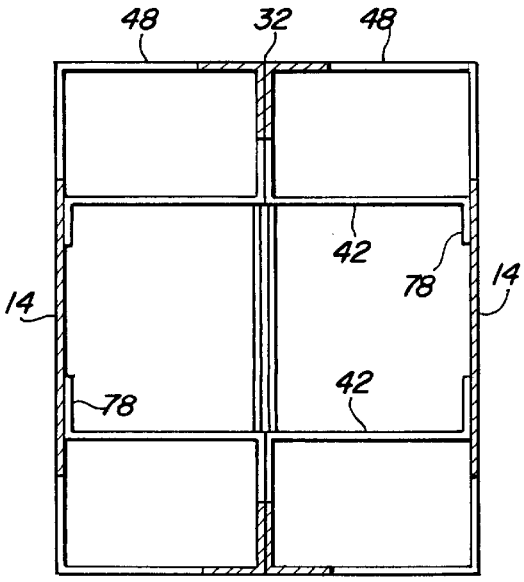
FIG. 10 is a longitudinal sectional view taken along line 10—10 of FIG. 9.

As can be seen from FIGS. 9 and 10, the opened carrier is in squared condition, typical of conventional basket carriers, with the end panels forming a right angle with the side panels. Note, however, that the bottle-receiving cells are not all the same size. The distance between the divider partitions 42 is substantially greater than the distance between the partitions and the nearest end panel, making the center cells wider than the end cells. The width of each center cell is greater than the diameter of a bottle and the width of each end cell is less than the diameter of a bottle. Thus the end cells are forced out by the entry of a bottle, causing the end panels and the end portions of the side panels between the fold lines 26 and 22 to bow out and curve about the bottles. The end bottles also cause the divider partitions 42 to bow out toward the center cell, so that the partitions are forced out against the center bottles. This arrangement is best illustrated in FIG. 3, which shows the relationship between the bottles and the divider partitions in the finished package. All the bottles in the carrier are thereby tightly held in place. Although the flexing of the end panels and the end portions of the side panels could take place without the fold lines 26, 28 and 30, it is preferred to include them since they facilitate the outward folding that occurs when the opened carrier is initially moved down over the bottles.

Figure 11:
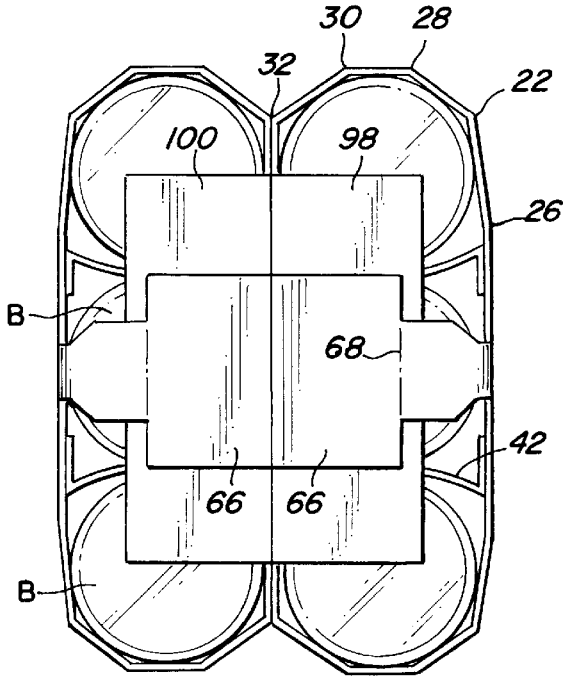
FIG. 11 is a bottom view of the carrier.

The final step in producing a package is to form the bottom panel after the bottles have been fully inserted into the cells and the necks of the middle bottles in the rows have passed through the bottle neck openings in the top panel. This is accomplished simply by folding the bottom panel section along the fold lines 38 and 92 in accordion pleat fashion to produce the arrangement shown in FIG. 2. Note that the lower portion 100 of the bottom panel section 90 has already been folded and adhered to the intermediate bottom panel section portion 98, as explained previously in connection with the initial folding steps of the carrier blank. The bottom panel flaps 66 are then folded about the fold lines 36 and glued to the bottom panel, one of the flaps 66 being adhered to the bottom panel section 100 and the other being adhered to the bottom panel section 98. The recessed bottom panel of the finished carrier is illustrated in FIG. 11. As indicated previously, the fold lines 70 in the side panel strips 50 and the fold lines 68 in the bottom panel flaps 66 facilitate any required flexing or bending of the strips 50 and the bottom panel flaps around the lower portions of the bottles in order for these elements of the carrier to tightly contact the bottles.

Although the fold lines 22 in the finished package are located in the curved end portions of the carrier, they function as the corner fold lines in the opened carrier as it exists prior to the loading step. Thus, despite the difference in width of the end cells and the unique bottom panel arrangement, the carrier blank and the collapsed carrier are similar in overall arrangement to conventional squared basket carriers. This allows the blanks to be glued and folded in the same manner as conventional squared basket carriers, thereby eliminating the need for different forming equipment to produce the collapsed carriers.

The bottom panel formed by the folded bottom panel section 90 and the bottom panel flaps 66 is very strong, being of two-ply construction, and quite capable of supporting heavy bottle loadings. This arrangement permits side panel cutouts to be provided even though the cutouts 44 result in smaller than normal bottom panel flaps 66. The side and end panel cutouts not only allow the lower portions of the bottles to be seen but also permit entry of packing tray support struts into the interior of the carrier to enable the carriers to be shipped in packing trays of molded plastic design. In addition, the rounded corners of the carrier not only tightly hold the end bottles in place but take up substantially no added space, thus allowing the carrier to fit into packing trays designed to hold single bottles only.

Note that in FIG. 9 the handle flaps 56 extend outwardly from the top panel as they do in blank form. They are intended to be folded under when the carrier is picked up, using opposite ends of the top panel as the handle. The handle flaps are illustrated in their folded operative condition in FIGS. 1–3.

Although the invention has been described in connection with a carrier designed to hold six beverage bottles, it will be understood that it also applies to carriers designed to hold other types of articles or to carry fewer or greater numbers of articles. It is contemplated that the invention need not necessarily be limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A basket-style article carrier, comprising:

opposite side panels;

a center support panel between the side panels, the center support panel dividing the carrier into article-receiving areas between the center support panel and the side panels;

opposite end panels connected to the side panels, each end panel being comprised of two adjacent end panel sections connected to the center support panel;

a bottom panel connected to the center support panel;

the side panels including spaced cutouts adjacent the bottom panel; and bottom panel flaps connected to the side panels between the cutouts, the bottom panel flaps being attached to the bottom panel.

2. A basket-style article carrier as defined in claim 1, wherein each end panel includes a cutout adjacent the center support panel and the bottom panel.

3. A basket-style article carrier as defined in claim 1, wherein the bottom panel is recessed from the side and end panels.

4. A basket-style article carrier as defined in claim 1, wherein the bottom panel is connected to the center support panel by a first fold line, the bottom panel including a second fold line defining a side edge of the bottom panel, the bottom panel being folded over upon itself about the second fold line.

5. A basket-style article carrier as defined in claim 4, wherein the bottom panel includes a third fold line defining an opposite side edge of the bottom panel, the bottom panel being folded over upon itself about the third fold line.

6. A basket-style article carrier as defined in claim 1, wherein the carrier includes a top panel connected to the side panels.

7. A basket-style article carrier as defined in claim 6, wherein the top panel includes a handle portion.

8. A basket-style article carrier as defined in claim 1, wherein the carrier includes a plurality of divider partitions extending from the center support panel to the side panels, the partitions dividing each article-receiving area into a plurality of cells, including end cells, the end cells having a width designed to be less than the diameter of a cylindrical article to be packaged in the cell whereby the end panels are able to curve outwardly to substantially conform to the shape of the cylindrical article in each cell.

9. A basket-style article carrier as defined in claim 8, wherein the cells created by the divider partitions include an interior cell in each article-receiving area, the width of the interior cells being designed to be greater than the diameter of a cylindrical article to be packaged in the cell, whereby the divider partitions are able to curve inwardly toward the interior cells.

10. A basket-style article carrier as defined in claim 1, wherein the end panels include vertical fold lines which facilitate outward curving of the end panels.

11. A basket-style article carrier as defined in claim 8, wherein the end panels include vertical fold lines to facilitate outward curving of the end panels.

12. A package, comprising:

a basket-style article carrier having opposite side panels;

a center support panel between the side panels, the center support panel dividing the carrier into article-receiving areas between the center support panel and the side panels;

opposite end panels connected to the side panels, each end panel being comprised of two adjacent end panel sections connected to the center support panel;

a bottom panel connected to the center support panel;

the side panels including spaced cutouts adjacent the bottom panel;

bottom panel flaps connected to the side panels between the cutouts, the bottom panel flaps being attached to the bottom panel;

a plurality of divider partitions extending from the center support panel to the side panels, the partitions dividing each article-receiving area into a plurality of cells; and a beverage bottle in each cell.

13. A package as defined in claim 12, wherein the carrier includes two end cells and an interior cell in each article-receiving area, the end cells before loading of a bottle into the end cells having a width less than the diameter of a bottle to be loaded and the interior cells before loading of a bottle into the interior cells having a width greater than the diameter of a bottle to be loaded whereby the end panels of the package curve outwardly to substantially conform to the shape of bottles in the end cells of the carrier and the divider partitions of the package curve inwardly, the divider partitions being in contact with all of the bottles.

14. A package as defined in claim 12, wherein the bottom panel is connected to the center support panel by a first fold line, the bottom panel including a second fold line defining a side edge of the bottom panel and a third fold line defining an opposite side edge of the bottom panel, the bottom panel being folded over upon itself about the second fold line and about the third fold line, the bottom panel being of two-ply construction on both sides of the center support panel.

15. A package as defined in claim 12, wherein the carrier includes a top panel connected to the side panels, the top panel overlying the bottles in the interior cells and having openings through which the necks of associated bottles extend.

16. A blank for forming a basket-style article carrier, comprising:

a top panel section connected by fold lines to opposite side panel sections;

each side panel section being connected by fold lines to opposite end panel sections;

each end panel section being connected by a fold line to a center support panel section;

each center support panel section being connected by a fold line to a divider partition flap;

one of the center support panel sections being connected by a fold line to a bottom panel section;

each side panel section including spaced cutouts remote from the top panel sections; and a bottom panel flap connected to each side panel section between the cutouts therein, the bottom panel flaps being designed to be attached to the bottom panel of a carrier formed from the blank.

17. A blank as defined in claim 16, wherein the bottom panel section includes two intermediate fold lines spaced from and substantially parallel to the fold line connecting the bottom panel section to said one center support panel section, the bottom panel section being designed to be folded upon itself about the two intermediate fold lines in a carrier formed from the blank.

18. A blank as defined in claim 16, wherein the top panel section includes a handle portion and bottle neck openings.

19. A blank as defined in claim 16, wherein the blank includes a cutout between each end panel section and an adjacent center support panel section.

20. A blank as defined in claim 16, wherein the end panel sections include vertical fold lines which facilitate outward curving of the end panels of a carrier formed from the blank.

* * * * *